US006098566A

United States Patent [19]

Metcalf

[11] Patent Number: 6,098,566

[45] Date of Patent: Aug. 8, 2000

[54] SWIM BOARD BRACKET

[76] Inventor: Robert Metcalf, 12852 Foothill Blvd., Sylmar, Calif. 91342

[21] Appl. No.: 09/354,648

[22] Filed: Jul. 16, 1999

[51] Int. Cl.[7] ..... B63B 17/00

[52] U.S. Cl. ..... 114/362; 248/235

[58] Field of Search ..... 114/343, 362, 114/364; 248/220.21, 221.11, 221.12, 224.8, 222.41, 235

[56] References Cited

U.S. PATENT DOCUMENTS 3,613,137 10/1971 Eccles ..... 114/362

4,762,081 8/1988 Porter ..... 114/364

4,854,534 8/1989 Porter ..... 114/362

5,632,224 5/1997 Schneider ..... 114/362

*Primary Examiner*—Stephen Avila

*Attorney, Agent, or Firm*—James E. Brunton

[57] ABSTRACT

The present invention relates generally to marine hardware. More particularly, the invention concerns an improved bracket that can be used to interconnect a support platform with a boat transom.

15 Claims, 5 Drawing Sheets

SWIM BOARD BRACKET

BACKGROUND OF THE INVENTION

1. Field of the Invention

The present invention relates generally to marine hardware. More particularly, the invention concerns an improved bracket that can be used to interconnect a support platform with a boat transom.

2. Discussion of the Prior Art

The use of small boats in the sports of water-skiing and diving has become increasingly popular in recent years. To assist the water skiers and divers in entering and leaving the boat, sport platforms such as swim boards are often affixed to the boat transom. In many instances the support platforms are rigidly and permanently affixed to the boat. In other cases devices have been suggested to enable the support platform to be removably affixed to the boat transom. Exemplary of one such device is that disclosed in U.S. Pat. No. 4,762,081 issued to Porter. The Porter device comprises a two-piece construction that provides attachment of a swim board to a boat transom, while permitting removal of the swim board from the boat when desired. One piece of the Porter platform bracket is a wall portion that bolts directly to the boat transom with through-bolts. This wall portion includes a transom plate for attachment to the transom and a hollow jacket or receiver member secured to the plate with the longitudinal axis of the receiver disposed parallel to the plane of the transom plate so that the receiver is oriented generally vertically when the transom plate is bolted to the transom. The other piece of the Porter platform bracket is a separate shelf portion, which screws directly to the swim board itself. The shelf portion includes a support plate for attachment to the swim board; a longitudinal shaft or post, which is mounted to the support plate at an angle so that the plane of the swim board will be parallel to the water's surface; and a reinforcing brace triangulating the two. The post portion of the shelf portion is sized to fit within the hollow receiver of the wall portion, with a channel cut-out of the receiver to accommodate the reinforcing brace. A cotter pin or other locking mechanism fits through a hole in the hollow receiver and solid post to lock the two in place, thereby securing the swim board to the boat.

A somewhat similar device to that disclosed in the Porter '081 patent is that disclosed in U.S. Pat. No. 4,854,534 also issued to Porter. This latter device also comprises a two-piece construction. One piece of the platform bracket is a wall portion that bolts directly to the boat transom with through-bolts. This wall portion includes a transom plate for attachment to the transom and an upper and lower flange member secured to the transom plate so that the flanges are oriented generally horizontally when the transom plate is bolted to the transom. The other piece of the platform bracket is a separate shelf portion, which screws directly to the swim support plate for attachment to the swim board; a vertical support member, which is mounted to the horizontal support plate at an angle so that the plane of the swim board will be parallel to the surface of the water; and a brace member triangulating the two. The vertical support member of the shelf portion includes a base that is sized to engage a connector in the lower flange member of the wall portion. A self-locking pin or other locking mechanism fits through complementary holes in the upper flange member of the wall portion and the horizontal support plate of the shelf portion to lock the two in place, thereby securing the swim board to the boat.

As will be better understood from the description which follows, the device of the present invention is specially designed to simplify the interconnection of the swim board component of the device with the connector member that is attached to the boat transom. More particularly, the apparatus of the present invention incorporates a strategically configured, dovetail-like, half-lap joint and a cooperating locking pin to securely interconnect the swim board component with the connector member. This novel construction enables the swim board component to be quickly and easily connected to an disconnected from the boat without the troublesome step of having to line tip a plurality of spaced-apart connector posts with spaced-apart posts receiving sleeves.

SUMMARY OF THE INVENTION

By way of summary, the novel platform bracket of the present invention for supporting a platform, such as a swim board from a boat transom includes a first member for attachment to the boat transom having a first face for engagement with the boat transom, a second face spaced apart from the front face and a third face disposed within a plane extending angularly with respect to the second surface. A locking pin is connected to and extends outwardly from the second face. A second member, to which the swim board platform is attached, mates with the first member in a novel manner. More particularly, the second member includes a body portion having an opening therethrough for receiving the locking pin provided on the body of the first member. The second member also includes a first face that is adapted for engagement with the second face of the first member and a second face that is spaced apart from the first face of the second member. The second member also uniquely includes a third face that is adapted to engage the third face of the first member, the third face of the second member being disposed in a plane extending angularly with respect to the first face of the second member. The apparatus further includes locking means for securing the locking pin within the opening formed in the body portion of the second member.

With the foregoing in mind, it is an object of the invention to provide a novel platform bracket for use in attaching a swim board or like platform to a transom of a small boat. More particularly, it is an object of the invention to provide a platform bracket of the aforementioned character that enables the swim board to be quickly and easily connected to and removed from the boat transom without the necessity of having to use hand tools such as screwdrivers, wrenches or the like.

Another object of the invention is to provide an apparatus of the character described in the preceding paragraphs which is of simple construction and uniquely embodies a dovetail-like, half-lap connector joint that enables the quick and easy interconnection of the swim board component with the supporting bracket component that is affixed to the boat transom. This novel connector joint permits the interconnection step to be easily accomplished without the necessity of precisely aligning spaced-apart connector shafts and cooperating sleeves of the character found in certain prior art constructions.

Another object of the invention is to provide a platform bracket that comprises two parts, namely a connector for attachment to the boat transom and a second, cooperating member that can be securely interconnected with the first member and maintained in a locked configuration by novel, easy to use locking means.

Another object of the invention is to provide an apparatus as described in the preceding paragraphs which is of a rugged construction requires minimum maintenance and one that can be inexpensively fabricated and installed.

DESCRIPTION OF THE INVENTION

Figure 1:
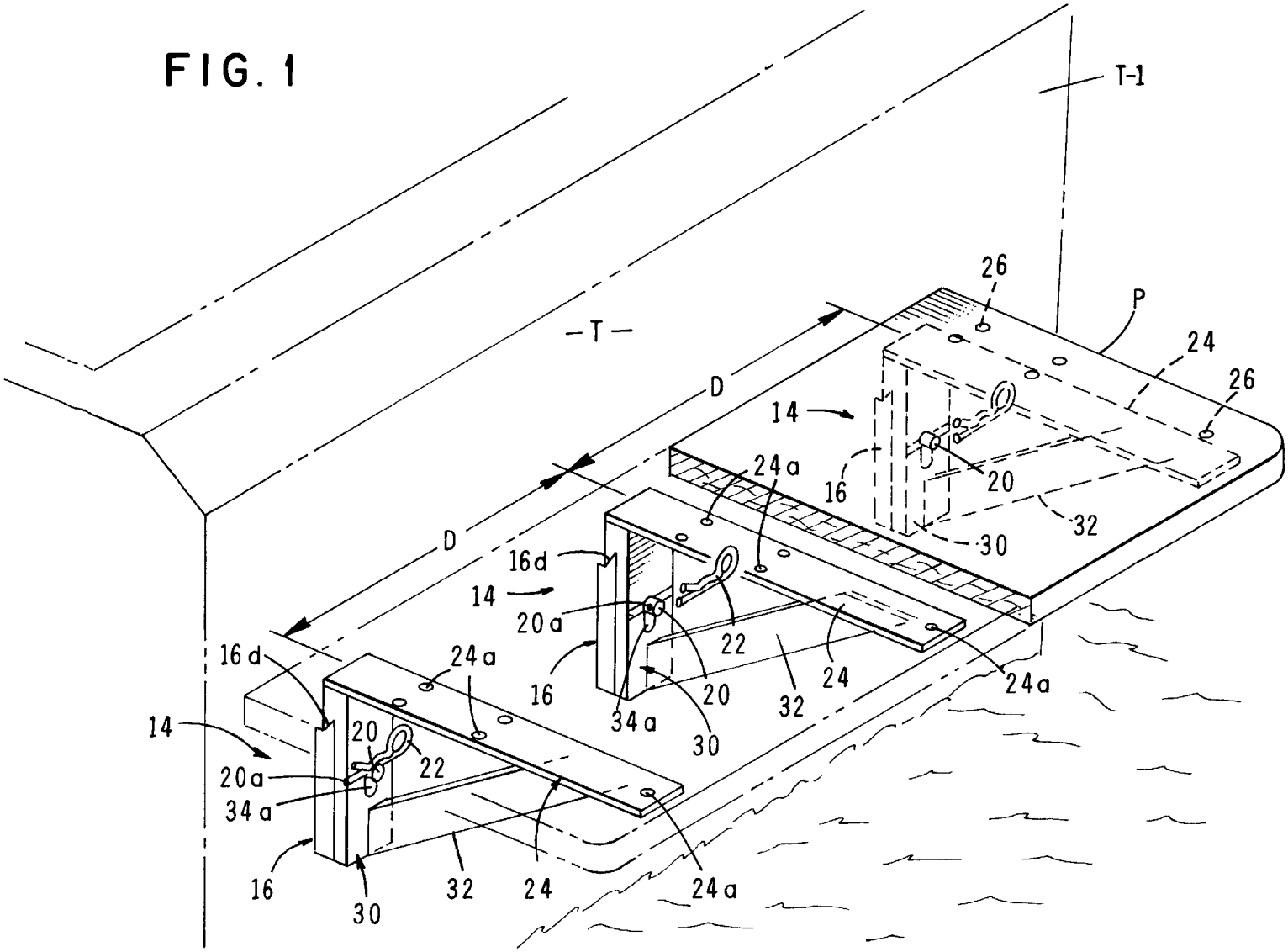
FIG. 1 is a generally perspective view of one form of the swim board connector apparatus of the invention shown mounted to the transom of a small boat.
Figures 2, 8:
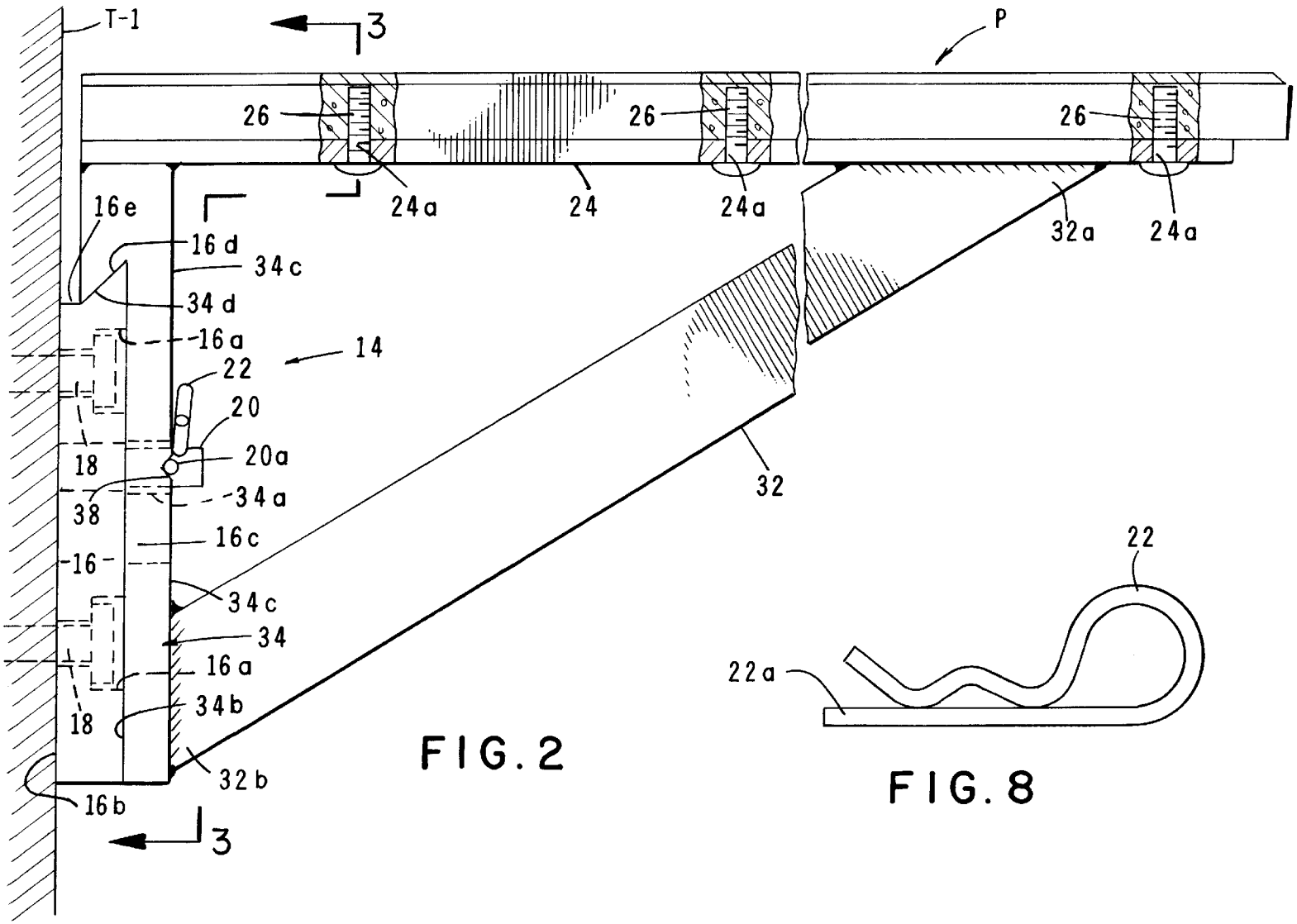
FIG. 2 is a greatly enlarged, side-elevational view of the apparatus shown in FIG. 1.
FIG. 8 is an enlarged side-elevational view of the locking pin of the apparatus of the invention.
Figure 4:
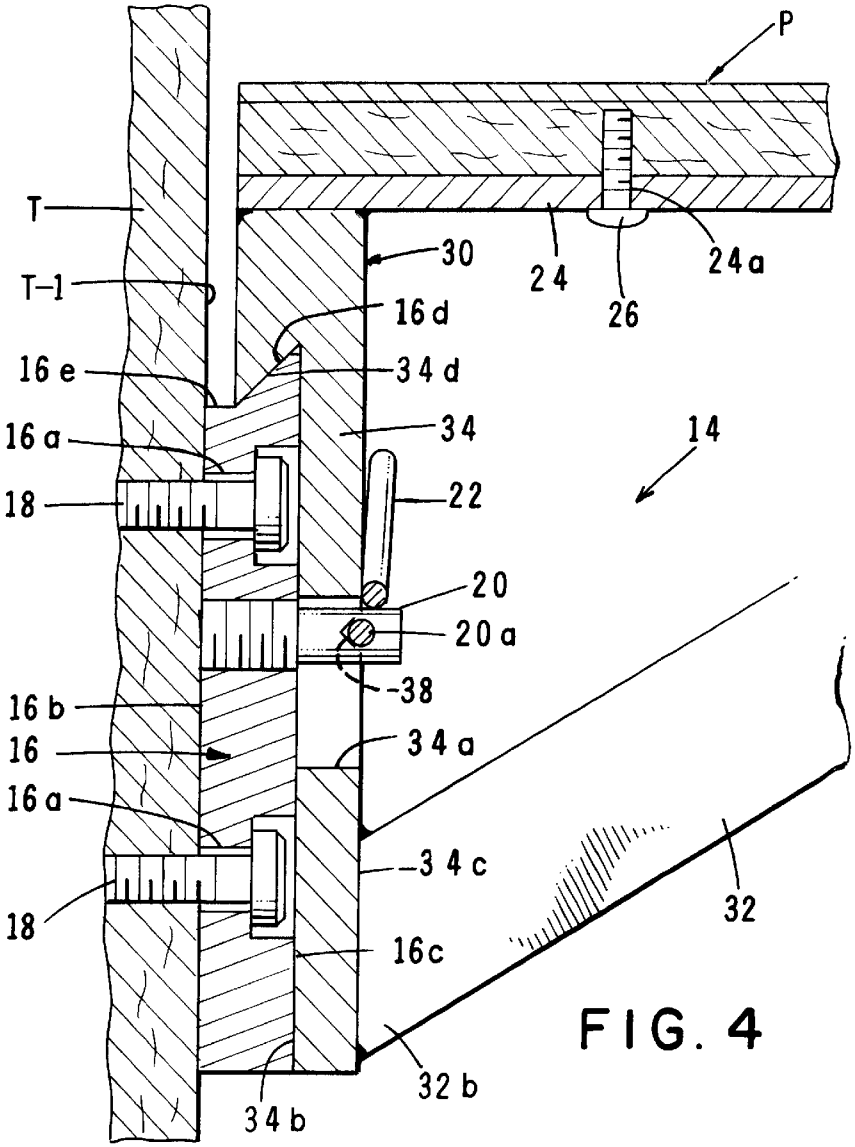
FIG. 4 is a cross-sectional view taken along lines 4—4 of FIG. 3.

Referring to the drawings and particularly to FIGS. 1 through 5, one form of the platform bracket assembly of the present invention for supporting a platform such as a swim board from a boat transom is there illustrated and generally identified by the numeral 14. The form of the invention shown in the drawings, platform bracket assembly 14, comprises a first member 16 that includes spaced-apart screw receiving through holes 16*a* that enables the first member to be interconnected with the boat transom "T"0 using suitable threaded connectors such as the connectors 18 shown in FIG. 6. First member 16 also includes a first generally planar face 16*b* which is adapted to closely engage the exposed surface "T-1" of the transom "T". Additionally, first member 16 includes a second, generally planer face 16*c* which is substantially parallel to and spaced apart from face 16*b*. A third face 16*d* is also formed on first member 16 and, as best seen in FIG. 2, is disposed within a plane that extends angularly with respect to the plane of second face 16*c* of member 16. Also forming an important part of first member 16 is an outwardly extending, generally cylindrical shaped locking pin 20 that is provided with a transverse bore 20*a* which, in a manner presently to be described, receives one leg of the locking means which here comprises a cotter 22.

Also forming a part of the platform bracket assembly of the present invention is a support member 24 that is adapted to be interconnected with and provide support to the swim board or platform "P". Support member 24 is provided with a plurality of spaced-apart screw holes 24*a* that are adapted to receive suitable connectors such as threaded connectors 26 (FIG. 5) which can be used for interconnecting platform "P"0 with the support member 24 in a manner well understood by those skilled in the art (see also FIG. 2).

Support member 24 is securely affixed to the important second member 30 of the invention by any suitable manner such as by welding. As best seen in FIG. 2, support member 24 extends generally perpendicularly from second connector member 30 and is supported in this position by a reinforcing brace 32. Base 32 has one end 32*a* connected to support member 24 and an opposite end 32*b* connected to second member 30 proximate its lower extremity. Once again, the ends of brace 32 can be interconnected with members 24 and 30 by any suitable means such as welding.

Second member 30 is of a novel construction and is adapted to be securely mated with first member 16 in the manner best seen in FIG. 2. As shown in FIG. 2, second member 30 is interconnected with first member 16 in a manner such that support member 24 is disposed within a plane generally perpendicular to the plane of the first face 16*b* of first member 16. It is to be noted that second member 30 includes a body portion 34 that is provided with an elongated, generally oblong shaped opening 34*a*. In a manner presently to be described, opening 34*a* receives the previously identified locking pin 20 (see FIG. 2). Body portion 34 also includes a generally planar first face 34*b* which is adapted to closely engage second face 16*c* of first member 16 in the manner shown in FIG. 2. Second member 30 further includes a second, generally planar face 34*c* which is spaced apart from and is generally parallel to first face 34*b*. Second member 30 includes a third face 34*d* which is disposed in a plane extending at an acute angle with respect to first face 34*b* of body portion 34 of second member 30. As illustrated in FIG. 2, angularly inclined face 34*d* closely engages inclined face 16*d* of first member 16 so as to precisely position second member 30 with respect to first member 16 when locking pin 20 is received through the oblong opening 34*a* provided in the body portion of second member 30. As indicated in the drawings, first member 16 is additionally provided with a fourth face 16*e* that extends generally perpendicular to face 16*b* and intersects inclined face 16*d* so as to form the previously mentioned dovetail-like, half-lap joint.

Figure 5:
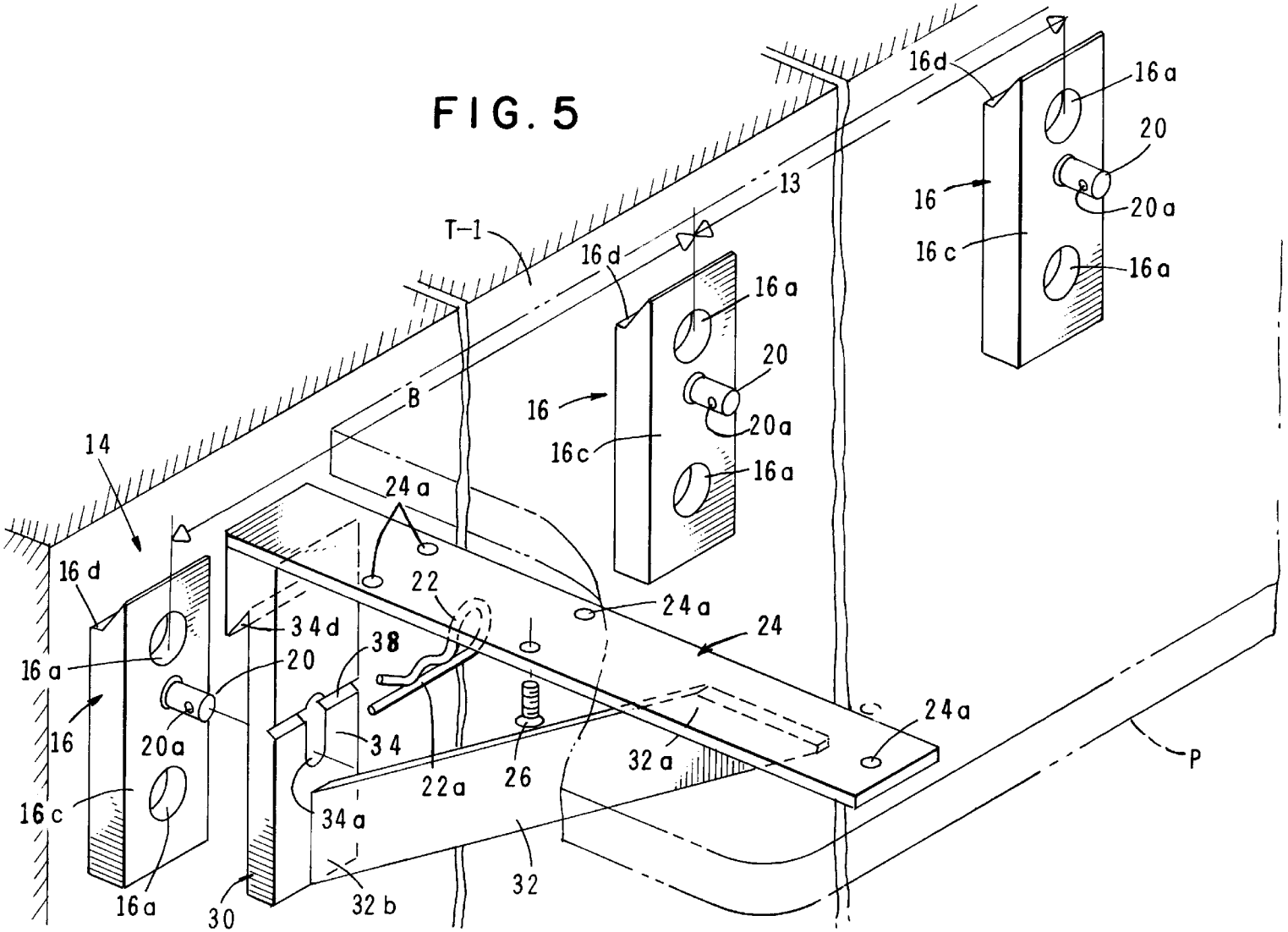
FIG. 5 is a generally perspective, exploded view similar to FIG. 1 illustrating the manner of interconnection of the swim board and connector components to the boat.

Also forming an important part of the apparatus of the invention is locking means for securely locking pin 20 within oblong opening 34*a* of second member 30. In the form of the invention shown in the drawings, this locking means comprises the previously identified cotter 22 which includes a leg 22*a* that is closely receivable within transverse aperture 20*a* formed in locking pin 20. To ensure that the cotter pin remains securely in place in a manner to urge faces 16*c* and 34*b* of the first and second components in close engagement, body portion 34 of second member 30 is provided with a transversely extending, generally V-shaped slot 38 (FIG. 5). Slot 38 is dimensioned so as to closely receive leg 22*a* of the cotter when the cotter pin is inserted into the transverse opening 20*a* formed in locking pin 20. With this construction, when the cotter 22 is securely in place, it will urge the first and second members into close engagement in the manner shown in FIG. 2 (see also FIGS. 3 and 4).

Figure 3:
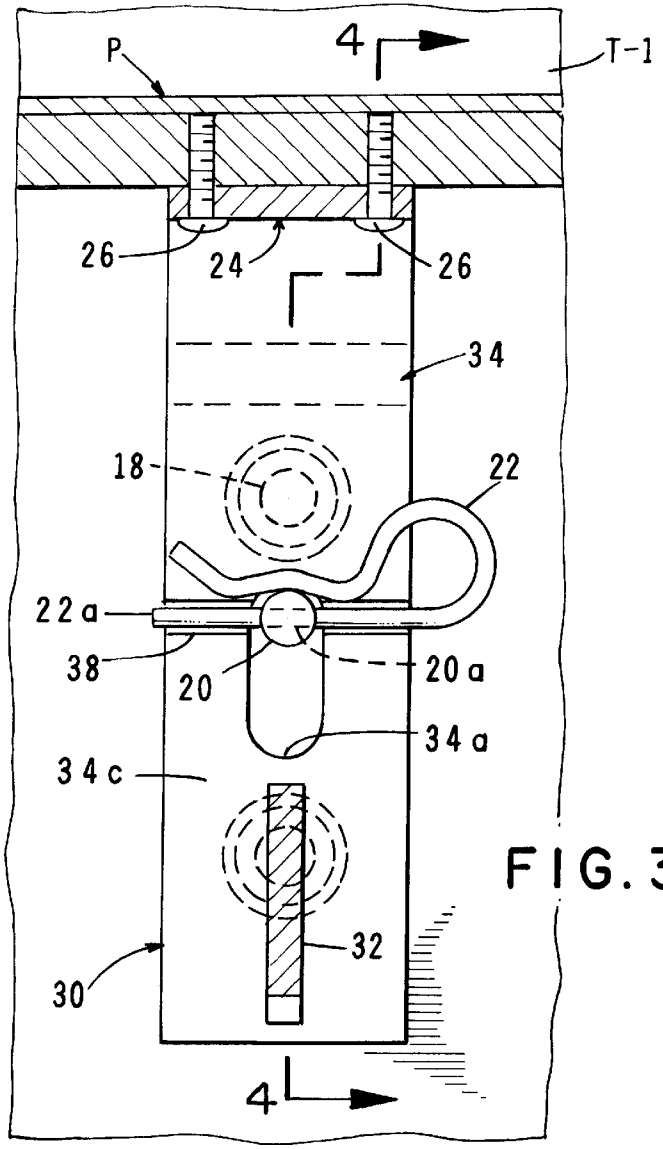
FIG. 3 is an enlarged, cross-sectional view taken along lines 3—3 of FIG. 2.
Figure 6:
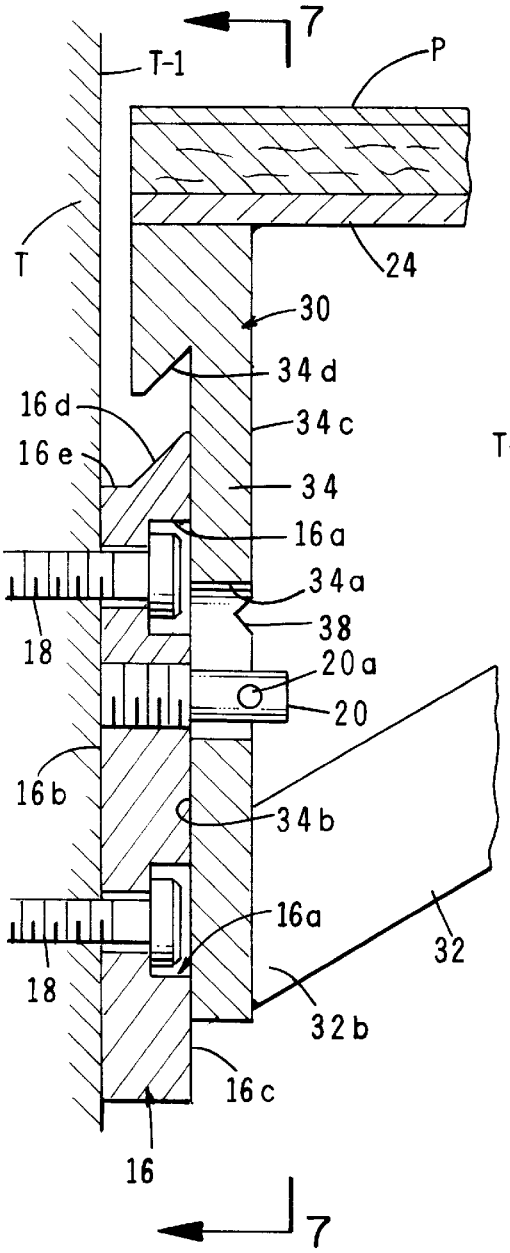
FIG. 6 is a cross-sectional view similar to FIG. 4 but showing the manner of mating the swim board component of the invention with the connector bracket component of the invention.
Figure 7:
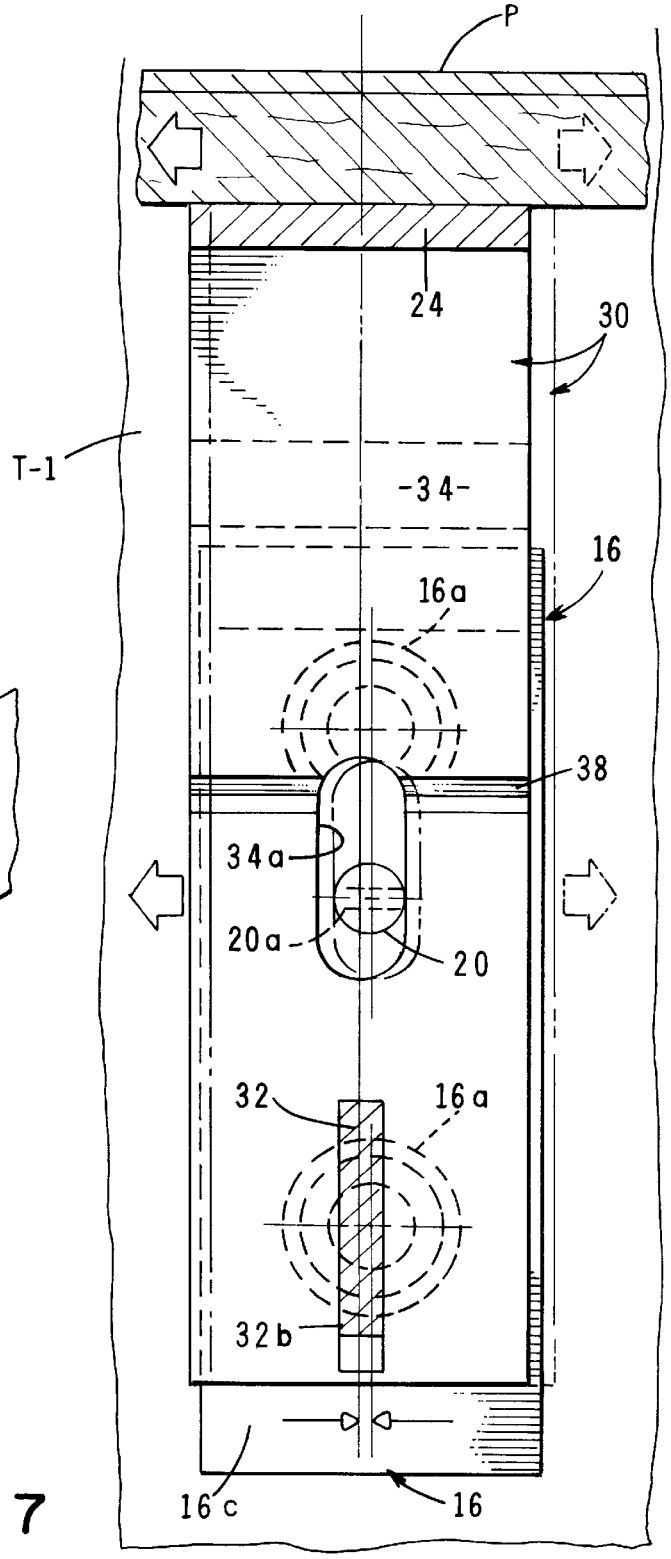
FIG. 7 is an enlarged, cross-sectional view taken along lines 7—7 of FIG. 6.

In using the apparatus of the present invention, with first member 16 securely affixed to the transom "T" by connectors 18 in the manner shown in FIG. 6, the assemblage made up of second member 30, support member 24, and platform "P"0 can be mated with member 16 in the manner illustrated in FIG. 6. More particularly, during the mating operation, the various locking pins 20 of members 16 are inserted into the lower portion of oblong openings 34*a* so that faces 16*d* and 34*d* of members 16 and 34 respectively are spaced apart. As indicated in FIG. 3, oblong opening 34*a* has a width slightly greater than the diameter of locking pin 20 so that during the mating step the locking pins need not be precisely aligned with the openings formed in the plurality of second members 30 which make up the swim board component assemblage and members 30 can be moved from side-to-side in the manner indicated by the arrows in FIG. 7. With the locking pins 20 received through the oblong opening 34*a* of the spaced-apart second members 30, the swim board component assemblage can then be lowered in a manner to bring inclined faces 16*d* and 34*d* into engagement in the manner shown in FIG. 2. With faces 16*d* and 34*d* in close engagement and with face 34*b* urged into close engagement with face 16*c*, leg 22*a* of cotter 22 can be inserted into V-shaped slot 38 and then forced through transverse opening 20*a* formed in the locking pin 20. With the cotter thusly in position, the swim board component assemblage is securely and stably interconnected with first member 16 and with the boat transom "T".

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A platform bracket for supporting a platform from a boat transom comprising:

(a) a first member for attachment to the boat transom, said first member having;

(i) a first face for engagement with the boat transom;

(ii) a second face spaced apart from said first face;

(iii) a third face disposed within a plane extending angularly with respect to said second face; and (iv) locking pin connected to and extending from said second face;

(b) a second member mateable with said first member, said second member comprising a body portion having an opening therethrough for receiving said locking pin, said body portion including:

(i) a first face for engagement with said second face of said first member;

(ii) a second face spaced apart from said first face of said second member; and (iii) a third face for engagement with said third face of said first member, said third face of said second member being disposed in a plane extending angularly with respect to said first face of said second member;

(c) locking means for securing said locking pin within said opening in said body portion of said second member; and (d) a support member for interconnection with the platform, said support member being connected to and extending from said second member.

2. The platform bracket as defined in claim 1 in which said locking pin has an aperture therethrough and in which said locking means comprises a cotter receivable through said aperture of said locking pin.

3. The platform bracket as defined in claim 1 in which said opening in said body of said second member comprises an oblong slot.

4. The platform bracket as defined in claim 1 further including a brace extending between said body portion of said second member and said support member.

5. The platform as defined in claim 1 in which said first member further includes a fourth face extending substantially perpendicular to said first face of said first member.

6. The platform as defined in claim 1 in which said locking means comprises a cotter and in which said second face of said body portion of said second member includes a generally V-shaped slot for closely receiving a portion of said cotter.

7. A platform bracket for supporting a platform from a boat transom comprising:

(a) a first member for attachment to the boat transom, said first member having;

(i) a first face for engagement with the boat transom;

(ii) a second face spaced apart from said first face;

(iii) a third face disposed within a plane extending angularly with respect to said second face; and (iv) locking pin connected to and extending from said second face;

(b) a second member mateable with said first member, said second member comprising a body portion having an oblong opening therethrough for receiving said locking pin, said body portion including:

(i) a first face for engagement with said second face of said first member;

(ii) a second face spaced apart from said first face of said second member; and (iii) a third face for engagement with said third face of said first member, said third face of said second member being disposed in a plane extending angularly with respect to said first face of said second member; and (c) locking means for securing said locking pin within said opening in said body portion of said second member, said locking means comprising a cotter receivable through said aperture of said locking pin; and (d) a support member connected to and extending from said second member.

8. The platform bracket as defined in claim 7 further including a brace extending between said body portion of said second member and said support member.

9. The platform bracket as defined in claim 8 in which said first member further includes a fourth face extending substantially perpendicular to said first face of said first member.

10. The platform bracket as defined in claim 8 in which said second face of said body portion of said second member includes a generally V-shaped slot for closely receiving a portion of said cotter.

11. A platform bracket for supporting a platform from a boat transom comprising:

(a) a first member for attachment to the boat transom, said first member having;

(i) a first face for engagement with the boat transom;

(ii) a second face spaced apart from said first face;

(iii) a third face disposed within a plane extending angularly with respect to said second face; and (iv) locking pin connected to and extending from said second face;

(b) a second member mateable with to said first member, said second member comprising a body portion having an oblong opening therethrough for receiving said locking pin, said body portion including:

(i) a first face for engagement with said second face of said first member;

(ii) a second face spaced apart from said first face of said second member, said second face having a generally V-shaped slot formed thereon; and (iii) a third face for engagement with said third face of said first member, said third face of said second member being disposed in a plane extending angularly with respect to said first face of said second member; and (c) locking means for securing said locking pin within said opening in said body portion of said second member, said locking means comprising a cotter receivable through said aperture of said locking pin and partially disposed within said slot formed in said second face of said second member (d) a support member for supporting the platform, said support member being connected to said second member and extending generally perpendicularly from said second face thereof; and (e) a brace extending between said body portion of said second member and said support member.

12. The platform bracket as defined in claim 11 in which said first member further includes a fourth face extending substantially perpendicular to said first face of said first member.

13. The platform bracket as defined in claim 11 in which said second face of said first member is generally parallel with said first face of said first member.

14. The platform bracket as defined in claim 13 in which said second face of said second member is generally parallel with said first face of said second member.

15. The platform bracket as defined in claim 14 in which said third face of said second member is disposed in a plane extending at an acute angle with respect to said first face of said second member.

* * * * *